US005421403A

United States Patent [19]

Aoki et al.

[11] Patent Number: 5,421,403

[45] Date of Patent: Jun. 6, 1995

[54] AIR CONDITIONER

[75] Inventors: Katsuyuki Aoki; Makoto Yoshihashi, both of Shizuoka; Katsuhisa Ootsuta, Hyogo; Motoo Sano, Shizuoka, all of Japan

[73] Assignee: Mitsubishi Denki Kabushiki Kaisha, Tokyo, Japan

[21] Appl. No.: 6,519

[22] Filed: Jan. 21, 1993

[30] Foreign Application Priority Data

Jan. 27, 1992 [JP] Japan ..... 4-012041

[51] Int. Cl.[6] ..... F24F 13/24

[52] U.S. Cl. ..... 165/122; 165/135; 165/151

[58] Field of Search ..... 165/135, 122, 151; 181/206

[56] References Cited

U.S. PATENT DOCUMENTS 4,359,134 11/1982 Jackson ..... 181/230
4,934,343 6/1990 Lee ..... 123/52 M

FOREIGN PATENT DOCUMENTS 391043 10/1908 France ..... 165/151
61-83892 4/1986 Japan ..... 165/151
61-272593 12/1986 Japan ..... 165/151
62-147291 7/1987 Japan .
62-175591 8/1987 Japan ..... 165/151
268432 3/1990 Japan .
331624 2/1991 Japan .

OTHER PUBLICATIONS

Patent Abstracts Of Japan, vol. 013, No. 022 (M-786), Jan 19, 1989, JP-A-63 233 223, Sep. 28, 1988.
Patent Abstracts Of Japan, vol. 014, No. 247 (M-0978), May, 25, 1990, JP-A-02 068 432, Mar. 7, 1990.
Patent Abstracts Of Japan, vol. 016, No. 010 (M-1199), Jan. 13, 1992, JP-A-02 233 233, Oct. 17, 1991.
Patent Abstacts Of Japan, vol. 015, No. 164 (M-1106), Apr. 24, 1991, JP-A-03 031 624, Feb. 12, 1991.

*Primary Examiner*—Allen J. Flanigan
*Attorney, Agent, or Firm*—Oblon, Spivak, McClelland, Maier, & Neustadt

[57] ABSTRACT

An air conditioner includes bent portions provided at edge portions of a plurality of fins juxtaposed on a heat exchanger, respectively. Each bent portion is located at an edge portion which is near a cross flow fan and on the sides of said fin facing the cross flow fan and lying generally between the cross flow fan and a coolant pipe of the heat exchanger. The bent portions are formed by bending the edge portions so as to be in parallel to the coolant pipe and staggered along an axis parallel to the coolant pipe. Thereby, the noise during the operation of the cross flow of the air conditioner can be reduced.

5 Claims, 5 Drawing Sheets

AIR CONDITIONER

BACKGROUND OF THE INVENTION

1. Field of the Invention

The invention relates to an air conditioner capable of reducing noise produced during rotation of a cross flow fan thereof.

2. Description of the Conventional Art

FIGS. 6 to 9 are diagrams showing a conventional air conditioner disclosed in, e.g., Japanese Patent Unexamined Publication Hei-3-31624/(1991).

In these figures, reference numeral 1 designates an air conditioner body, which is a wall type; 2, a heat exchanger disposed within the air conditioner body 1; and 3, a cross flow fan disposed in parallel to the heat exchanger 2 inside the body 1. The air conditioner body 1 draws air from a room into an inlet 4 by rotation of the cross flow fan 3, exchanger heat with the air by passing the air through the heat exchanger 2, and blows the heat-exchanged air out into the room from an outlet 5. The heat exchanger 2 includes a plurality of juxtaposed fins 6 and coolant pipes 7 passing through the plurality of fins 6. The drawn in air threads its way through the coolant pipes 7 among the plurality of juxtaposed fins 6. On an edge portion of the fin 6 closest to the cross flow fan 3 is a bent portion **6*a* formed by pressing the same portion to right and left in a planar direction of the fin 6 as shown in FIG. 7**.

The operation of the air conditioner will be described next. The air drawn from the inlet 4 by the rotation of the cross flow fan 3 enters into the cross flow fan 3 after passing through the heat exchanger 2. A vortex 8 such as shown in FIG. 8 is produced on the downstream side of each coolant pipe 7. As a result, the wind speed of the air immediately after the heat exchanger 2 drops locally at each vortex 8 as shown in FIG. 9. When the vortex 8, which marks a local drop in the wind speed, has entered the cross flow fan 3, there is a change in lift generated at each blade of the cross flow fan 3 which causes pressure pulsation, which in turn causes noise during rotation of the cross flow fan (the noise being a component whose frequency $f=n\times N\times Z$, where n is an integer and N is the number of blades).

However, since the conventional air conditioner has the bent portion **6*a* on the fan 6, the air 9 flowing through the bent portion 6*a* goes behind the coolant pipe 7, suppressing the vortexes 8 adjacent to the bent portion 6*a*. This causes a length L of each vortex 8 to be reduced to La, impeding the vortexes 8 from entering into the cross flow fan 3. As a result, the noise during the rotation of the cross flow fan 3** can be reduced.

To reduce the noise during the rotation of the cross flow fan 3 in the thus constructed air conditioner, the heat exchanger 2 and the cross flow fan 3 must be separated by at least a distance La, which is the length of the reduced vortex 8. Therefore, such a distance has been the smallest possible distance between the heat exchanger 2 and the cross flow fan 3 to make the air conditioner thin. Making an air conditioner thinner by putting both components 2, 3 closer to each other by a distance smaller than the above-noted distance aggravates the noise during the rotation of the cross flow fan 3.

SUMMARY OF THE INVENTION

The invention has been made to overcome the above-mentioned problem. Accordingly, an object of the invention is to provide an air conditioner in which noise during the rotation of the cross flow fan can be reduced while reducing the thickness of the air conditioner.

To achieve the above object, the invention is applied to an air conditioner, in which bent portions are provided at edge portions of a plurality of fins juxtaposed on a heat exchanger, respectively. Each bent portion is located at an edge portion near a cross flow fan. The edge portion is on the sides of the fins facing the cross flow fan and lying generally between the cross flow fan and a coolant pipe of the heat exchanger. The bent portions are formed by bending the edge portions so as to be in parallel to the coolant pipe and staggered along an axis parallel to the coolant pipe.

Further, the invention is applied to an air conditioner, in which a baffle plate is provided on edge portions, instead of the staggering bent portions. The baffle plate is formed by integrating a plurality of small plates. The small plates are staggered along an axis parallel to the coolant pipe.

In the invention, vortexes produced on the side of the cross flow fan of the coolant pipe are deflected in accordance with the distance and shape of the staggered bent portions. That is, the position at which each vortex enters the cross flow fan can be changed by changing the distance and shape of each bent portion. Therefore, a noticeable noise reduction during the rotation of the cross flow fan can be implemented by optimizing the distance between vortexes in function of the number of blades.

The above function can be similarly exhibited when a baffle plate is used in place of the bent portions.

DESCRIPTION OF THE PREFERRED EMBODIMENTS

An embodiment of the invention will be described with reference to the drawings.

Figure 1:
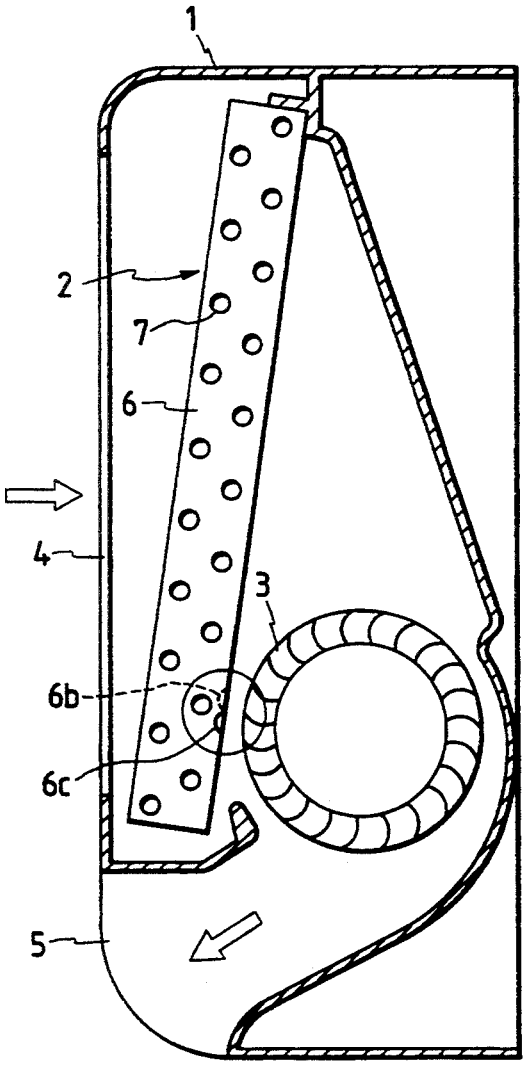
FIG. 1 is a longitudinal sectional diagram showing an air conditioner, which is an embodiment of the invention.
Figure 2:
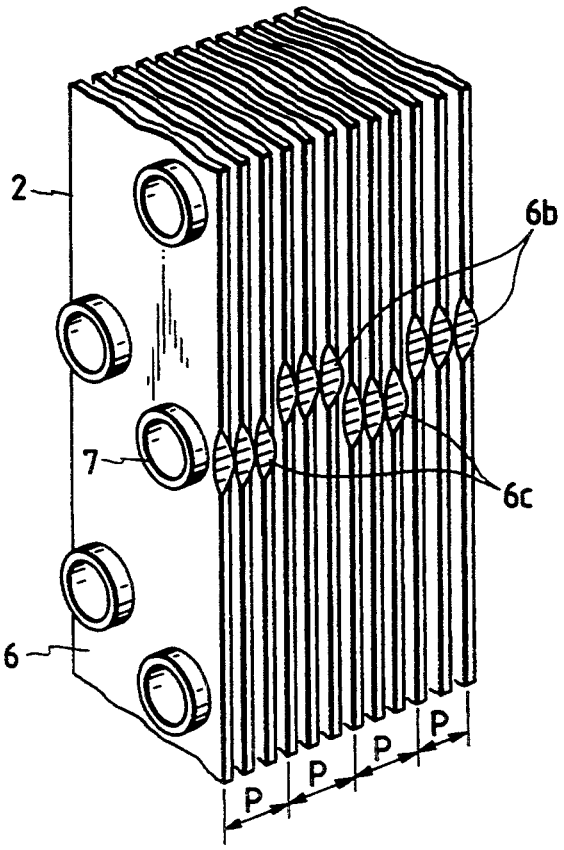
FIG. 2 is a perspective view showing the main portion of a heat exchanger of the embodiment.
Figure 3:
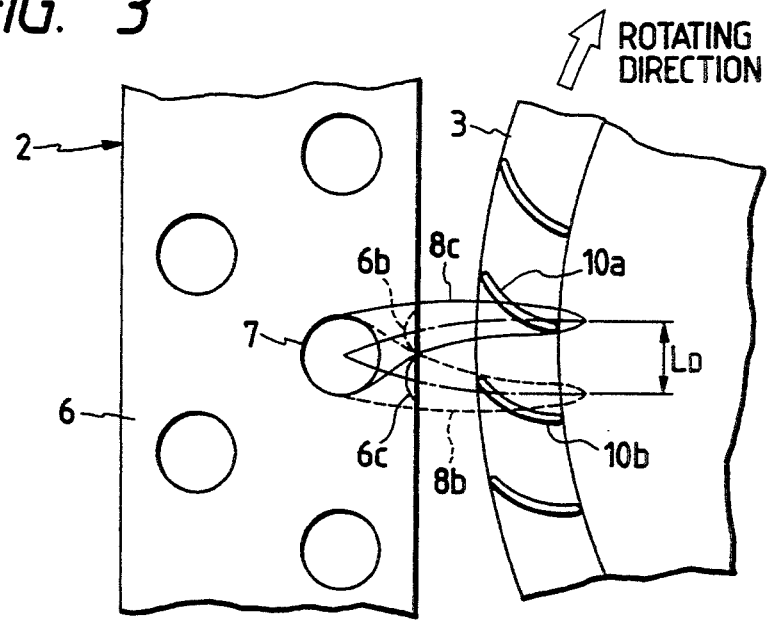
FIG. 3 is a diagram showing in detail vortexes of air produced by a coolant pipe in the embodiment.

In FIGS. 1 to 3, reference numerals 1 to 7 designate the same components as those in the conventional air conditioner. Reference numerals **6*b* and 6*c* designate an upper side bent portion and a lower side bent portion provided on each of fins 6**.

The upper side bent portion **6*b* and the lower side bent portion 6*c* are arranged on an edge portion of each of the plurality of fins 6. The edge portion is close to the cross flow fan 3 and faces the cross flow fan 3 along the coolant pipe 7. As shown in FIG. 2, the bent portions 6***b*, 6*c* are disposed in two groups, respectively. Each group consists of three portions and is staggered along the length of the coolant pipe 7.

The operation of the air conditioner of the invention will be described next. The air drawn from the inlet 4 by the rotation of the cross flow fan 3 passes through the heat exchanger 2. Vortexes 8 of the air produced on the side of the cross flow fan 3 of the coolant pipe 7 becomes as shown in FIG. 3. That is, the air threading its way through each fin 6 having an upper bent portion 6*b* forms a downward vortex 8*b* that is deflected downward relative to the coolant pipe 7 as shown by the broken line, whereas the air threading its way through each fin 6 having a lower bending portion 6*c* forms an upward vortex 8*c* that is deflected upward relative to the coolant pipe 7 as shown by the solid line. The downward vortex 8*b* and the upward vortex 8*c* are formed repetitively along the length of the coolant pipe 7 at a pitch P equal to the pitch between the group of upper bent portions 6*b* and the group of lower bent portions 6*c* shown in FIG. 2. Parallel air flow streams along the length of the heat exchanger 2 which lead from the heat exchanger 2 diffuse with each other between the heat exchanger 2 and the cross flow fan 3 to permit a negative interference to occur.

FIGS. 4A to 4D are time charts showing noise during the rotation of the cross flow fan 3 produced by interference between the upper vortex portion 8*c* and a blade 10*a* as well as between the lower vortex portion 8*b* and a blade 10*b*. The blades 10*a*, 10*b* are two neighboring blades of the cross flow fan 3.

The noise during the rotation is produced in the following way by interference between the blades and the vortexes. When each blade starts interfering with the corresponding vortex as the cross flow fan 3 rotates, the flow velocity of the vortex is decreased with time. This causes the angle of incidence of the flow of the incoming vortex relative to the blade to increase with time, causing a change in lift in the positive direction. When each blade passes by the portion at which the flow velocity of the corresponding vortex becomes lowest as the cross flow fan 3 has further rotated, the flow velocity of the vortex relative to the blade starts increasing with time, causing the relative angle of incidence to decrease with time. This in turn causes a change in localized air pressure in the negative direction.

Figures 4A, 4B, 4C, 4D:
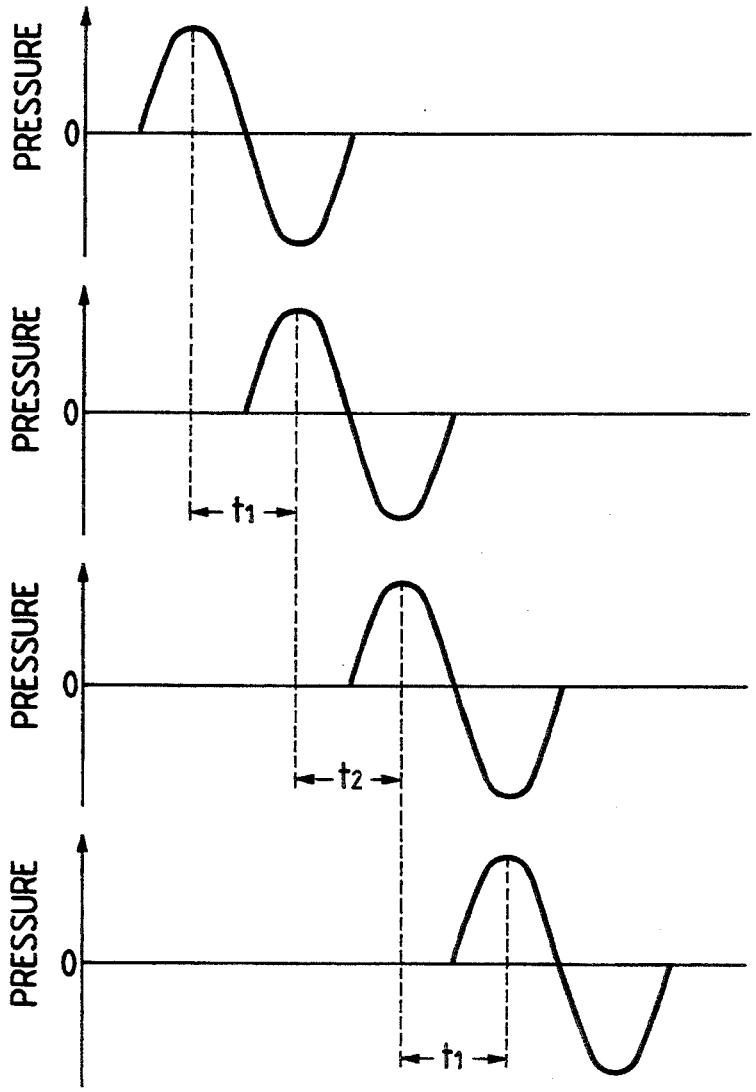
FIGS. 4A to 4D are diagrams showing sound pressure levels in the embodiment.
Figure 6:
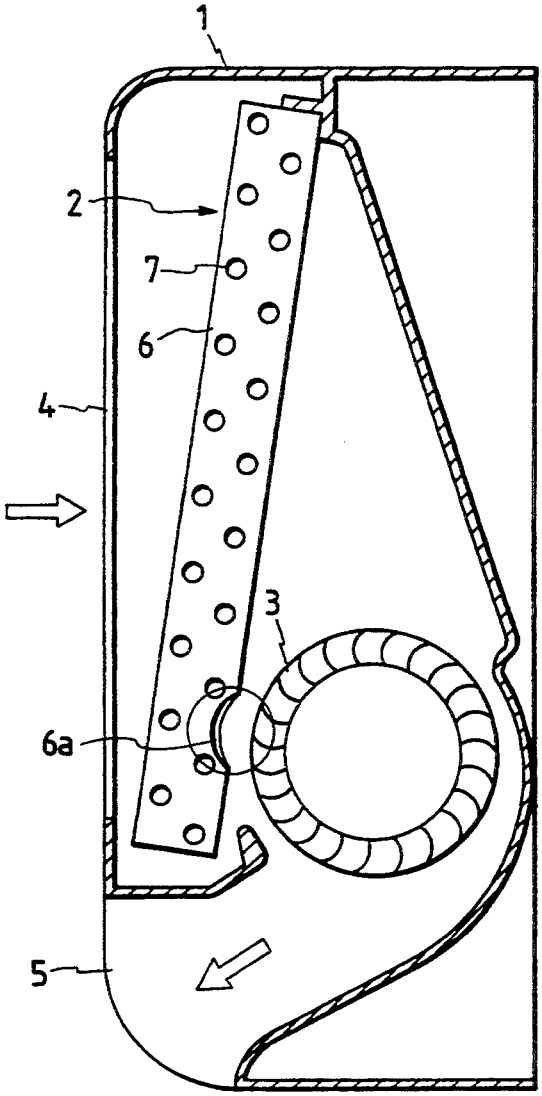
FIG. 6 PRIOR ART
FIG. 6 is a longitudinal sectional view showing a conventional air conditioner.
Figure 7:
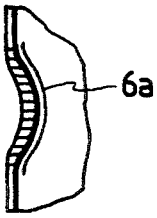
FIG. 7 PRIOR ART
FIG. 7 is an enlarged perspective view of a bent section of the fin shown in FIG. 6.
Figure 8:
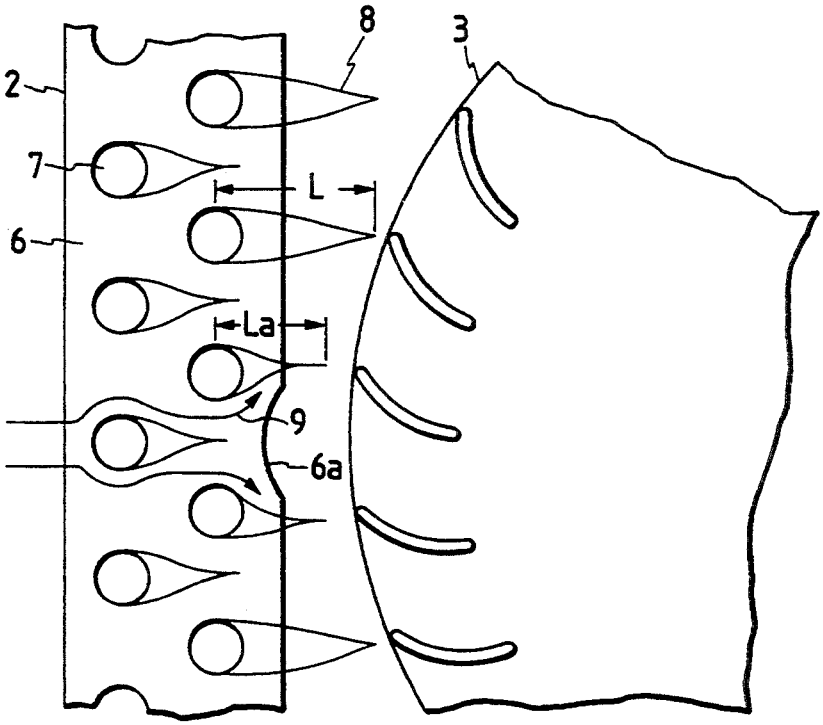
FIG. 8 PRIOR ART
FIG. 8 is a detailed diagram showing vortexes of air produced by coolant pipes in the conventional air conditioner.
Figure 9:
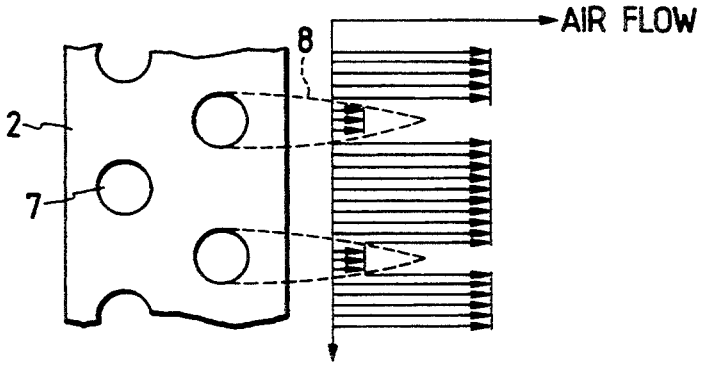
FIG. 9 PRIOR ART
FIG. 9 is a diagram showing a speed distribution of air immediately after the air has passed through the heat exchanger in the conventional air conditioner.

Therefore, as shown in FIGS. 4A to 4D, each time chart shows a change in sound producing localized air pressure from positive values to negative values with respect to the time axis. FIG. 4A shows a change in localized air pressure due to interference between the blade 10*a* and the downward vortex 8*b*. FIG. 4B shows a change in localized air pressure due to interference between a portion neighboring the blade 10*a* in the axial direction and the upward vortex 8*c*, the blade 10*a* having interfered with the downward vortex 8*b* in FIG. 4A. If the time at which the maximum positive localized air pressure is produced in the case of FIG. 4B is synchronized with the time at which the maximum negative localized air pressure is produced in the case of FIG. 4A, the produced air pressure and resulting sound is canceled due to interference between both pressures. A time difference $t_1$ is substantially equal to $60\ L_D/(\pi DN)$, where $L_D$ is the distance between the position at which the upward vortex 8*c* enters the cross flow fan 3 and the position at which the downward vortex 8*b* enters the cross flow fan 3, i.e., the distance between the vortexes; and N is the number of revolutions (rpm). The interference sound can be reduced to a significant degree by changing the distance between the upper bent portion 6*b* and the lower bent portion 6*c* as well as the shape thereof.

FIGS. 4C and 4D show changes in sound producing air pressure produced by interference between the blade 10*b* and the downward vortex 8*b* and between the blade 10*b* and the upward vortex 8*c*, the blade 10*b* being located after the blade 10*a*. As in FIGS. 4A and 4B, the produced noise similarly decays if the distance between vortexes $L_D$ is optimized. Furthermore, the sound derived from the negative air pressure of FIG. 4B and the air derived from the positive sound pressure of FIG. 4C can also be reduced by optimizing the relationship between the number of blades and the distance between vortexes $L_D$ so that the interference sound between the blade 10*a* and the upward vortex 8*c* is in phase with the interference sound between the blade 10*b* and the downward vortex 8*b*.

As described above, the vortexes 8*b*, 8*c* are deflected in accordance with the distance between the bent portions 6*b*, 6*c* and the shape thereof in the embodiment. Thus, the positions at which the vortexes 8*b*, 8*c* enter the cross flow fan 3 are optimized so as to match the number of blades.

That is, the bent portions 6*b*, 6*c* in the embodiment are designed so that the interference sound between the blade 10*a* and the vortex 8*b*, the interference sound between the blade 10*a* and the vortex 8*c*, the interference sound between the blade 10*b* and the vortex 8*b*, and the interference sound between the blade 10*b* and the vortex 8*c* are 180° out of phase. As a result, according to the air conditioner of the invention, the noise due to the rotation of the cross flow fan can be greatly reduced.

Figure 5:
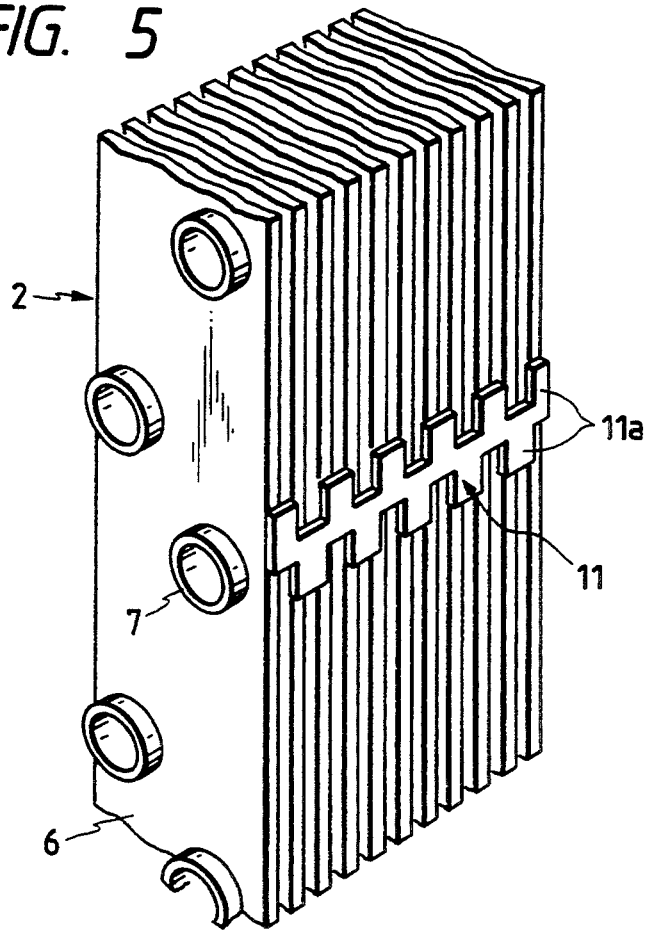
FIG. 5 is a perspective view showing an air conditioner, which is another embodiment of the invention.

While each of the bent portions 6*b*, 6*c* is provided on an edge portion of a fin 6 in a staggered manner, the same advantage can be obtained by mounting such a baffle plate as shown in FIG. 5. That is, the baffle plate is formed integrally while staggering a plurality of small plates 11a in the longitudinal direction of the coolant pipe 7. Further, while each of the bent portions 6*b*, 6*c* is provided on an edge portion of a fin 6 in the above embodiment, the same advantage may also be provided by arranging projections instead of the bent portions.

As described in the foregoing pages, with the featured construction of the air conditioner of the invention, noise reduction during the rotation of the cross flow fan can be achieved even if the air conditioner is made thin in structure by locating the heat exchanger close to the cross flow fan.

What is claimed is:

1. An air conditioner comprising:

a cross flow fan and a heat exchanger, said heat exchanger being located near and in an upstream side of said cross flow fan so as to be in parallel to said cross flow fan, said air conditioner introducing air from an inlet thereof by rotation of said cross flow fan, said air being subjected to heat exchange at said heat exchanger and then being blown out of an outlet of said air conditioner; wherein:

bent portions are provided at edge portions of a plurality of fins juxtaposed on said heat exchanger, respectively, each of said bent portions being located at an edge portion near said cross flow fan, said edge portion being on the sides of said fins facing the cross flow fan and lying generally between the cross flow fan and a coolant pipe of said heat exchanger, said bent portions being formed by bending the edge portions so as to be in parallel to the coolant pipe and being staggered along an axis parallel to the coolant pipe.

2. An air conditioner comprising:

a cross flow fan and a heat exchanger, said heat exchanger being located near an in an upstream side of said cross flow fan so as to be in parallel to said cross flow fan, said air conditioner introducing air from an inlet thereof by rotation of said cross flow fan, said air being subjected to heat exchange at said heat exchanger and then being blown out of an outlet of said air conditioner; wherein:

a baffle plate is provided on edge portions of a plurality of fins juxtaposed on the heat exchanger and near the cross flow fan, said edge portions being on the sides of said fins facing the cross flow fan and lying generally between the cross flow fan and a coolant pipe of the heat exchanger, said baffle plate being formed by integrating a plurality of small plates, said small plates being staggered along an axis parallel to the coolant pipe.

3. An air conditioner comprising:

a cross flow fan disposed in an air conditioner body;

a heat exchanger disposed in parallel to said cross flow fan, said heat exchanger including a plurality of juxtaposed fins and a plurality of coolant pipes passing through said fins, said heat exchanger carrying out a heat exchange by rotation of said cross flow fan;

upper air flow deflecting means, provided at edge portions of said juxtaposed fins of said heat exchanger, for deflecting air flow to form a downward vortex; and lower air flow deflecting means, provided at edge portions of said juxtaposed fins of said heat exchanger, for deflecting air flow to form an upward vortex;

wherein said first and second air flow deflecting means are repetitively formed in parallel to said coolant pipe and staggered along an axis parallel to said coolant pipe.

4. An air conditioner as claimed in claim 3, wherein a first sound producing air pressure is generated by interference between a blade of said cross flow fan and said downward vortex due to said upper air flow deflecting means and a second sound producing air pressure is generated by interference between said blade and said upward vortex due to said lower air flow deflecting means, wherein said first and second air pressures are reversed in phase to thereby cancel a sound produced by said first and second air pressures.

5. An air conditioner as claimed in claim 3, wherein a first sound producing air pressure is generated by interference between a blade of said cross flow fan and said downward vortex due to said upper air flow deflecting means and a third sound producing air pressure is generated by interference between a succeeding blade of said blade and said upward vortex due to said lower air flow deflecting means, wherein said first and third air pressures are reversed in phase to thereby cancel a sound produced by said first and third air pressures.

* * * * *